US005246481A

United States Patent [19]

Scheie

[11] Patent Number: 5,246,481

[45] Date of Patent: Sep. 21, 1993

[54] PRODUCTION OF METALLIC POWDER

[75] Inventor: Hugh C. Scheie, St. Albert, Canada

[73] Assignee: Sherritt Gordon Limited, Edmonton, Canada

[21] Appl. No.: 966,627

[22] Filed: Oct. 26, 1992

[51] Int. Cl.[5] ..... C22B 23/04

[52] U.S. Cl. ..... 75/374; 423/139

[58] Field of Search ..... 75/374, 365, 364, 353, 75/430, 362; 423/143, 139, 141, 145

[56] References Cited

U.S. PATENT DOCUMENTS

| | | | |
|---|---|---|---|
| 2,767,081 | 10/1956 | Mackin et al. | 75/374 |
| 2,853,374 | 9/1958 | Schaufelberger | 75/374 |
| 3,775,098 | 11/1973 | Kunda et al. | 75/374 |
| 4,761,177 | 8/1988 | Chou et al. | 75/374 |

FOREIGN PATENT DOCUMENTS

| | | | |
|---|---|---|---|
| 890706 | 3/1962 | United Kingdom | 75/374 |

OTHER PUBLICATIONS

Schoening, M. A. et al "The Role of Chemical Engineering in Development of the Sherritt Gordon Nickel Refining Operation", Chemical Engineering Conference, Montreal, Apr. 22, 1958.

*Primary Examiner*—R. Dean
*Assistant Examiner*—Sikyin Ip
*Attorney, Agent, or Firm*—Arne I. Fors; D. Doak Horne

[57] ABSTRACT

A process for the production of powdered metallic cobalt by reduction of cobaltous ammonium sulphate solutions. A soluble silver salt, preferably silver sulphate, is added in an amount to provide a soluble silver to cobalt weight ratio in the range of 1 to 10 g silver:1 kg cobalt, an organic dispersant such as bone glue or polyacrylic acid, or mixture thereof, is added in an amount of 0.01. to 2.5% of the weight of the cobalt, an ammonia to cobalt mole ratio of about 1.5:1 to 3.0:1 is established, and the solution is heated to a temperature in the range of 150 to 250° C., preferably about 175° C., with agitation under a hydrogen pressure of 2500 to 5000 kPa for a time sufficient to reduce the cobaltous sulphate to cobalt metal powder.

12 Claims, 2 Drawing Sheets

PRODUCTION OF METALLIC POWDER

BACKGROUND OF THE INVENTION

This invention relates to a process for the production of powdered metallic cobalt and, more particularly, relates to a process for the production of powdered metallic cobalt by reduction of cobaltous ammonium sulphate solutions.

A method for the production of cobalt from aqueous cobaltous ammonium sulphate solutions by reduction with gaseous hydrogen at elevated temperatures and pressures was disclosed in a paper entitled The Hydrometallurgical Production of Cobalt published in the Transactions, CIM, 65(1962), 21-25 by W. Kunda, J.P. Warner and V.N. Mackiw. In the nucleation stage, reduction is initiated and fine metal particles or nuclei are formed in the solution. In the densification stage, metal is precipitated from solution onto the preformed "seed" particles to produce larger particles. This latter step is repeated until the powder reaches the desired size.

In order to initiate the formation of the metal particles during the nucleation stage, a nucleation catalyst must be added to the aqueous metal salt-containing solution. The method developed by Kunda et al, and in commercial use by Sherritt Gordon Limited, was a mixture of sodium sulphide and sodium cyanide to promote nucleation of cobalt powder. This method can be used to produce powders of less than 25 microns in size; however, the powder is relatively high in sulphur and carbon content (0.3 to 0.8% C and 0.2 to 0.5% S). When powders of finer size are required, the carbon and sulphur levels normally are higher since fewer densifications result in less dilution of the initial carbon and sulphur in the nucleation powder.

In addition to the potentially high carbon and sulphur levels reporting to the product powder, the use of sodium cyanide is undesirable because of its toxic nature.

It is a principal object of the present invention to provide a process for the production of spherical or nodular cobalt powder having an average particle size less than 25 microns, as measured by FSSS, with low carbon and sulphur contents.

It is another object of the present invention to provide a process which does not require sodium cyanide for the nucleation of fine cobalt powder.

SUMMARY OF THE INVENTION

It has been found that the production of fine metallic cobalt powder suitable for use as seed in the preparation of coarser powder can be effected from ammoniacal cobalt sulphate solutions by the addition of a soluble silver salt, preferably silver sulphate, as a nucleating catalyst, in the presence of suitable organic compounds such as bone glue, polyacrylic acid and bone glue/-polyacrylic acid mixture to control growth and agglomeraton of the cobalt particles. In its broad aspect, the method of the invention for the production of cobalt powder from a solution containing cobaltous ammonium sulphate comprises adding silver sulphate in an amount to provide a soluble silver to cobalt weight ratio in the range of 1.0 to 10 g of silver per 1 kg of cobalt to be reduced, adding bone glue and/or polyacrylic acid in an amount effective to prevent agglomeration of the cobalt metal powder to be produced, and heating said solution to a temperature in the range of 150 to 250° C. with agitation under a hydrogen pressure of 2500 to 5000 kPa for a time sufficient to reduce the cobaltous sulphate to cobalt metal powder.

More particularly, the process of the invention comprises adding ammonia to a solution of cobaltous sulphate containing a cobalt concentration of 40 to 80 g/L to yield an ammonia to cobalt mole ratio of about 1.5 to 3.0:1, adding silver sulphate to yield a silver to cobalt weight ratio of about 1.0 g to 10 g silver:1 kg cobalt, adding a mixture of bone glue and polyacrylic acid in an amount of 0.01 to 2.5% of the weight of the cobalt, heating said mixture to a temperature in the range of 150° to 250° C. and agitating said mixture in a hydrogen atmosphere at a total pressure in the range of 2500 to 5000 kPa until cobaltous cobalt is reduced to cobalt metal powder.

Preferably, the silver sulphate is added in an amount to yield a silver to cobalt weight ratio of about 4 g silver to 1 kg cobalt, an ammonia to cobalt weight ratio to about 2.5:1, a total pressure of about 3500 kPa,and the mixture is heated to about 180° C.

BRIEF DESCRIPTION OF THE DRAWINGS

The method of the invention will now be described with reference to the accompanying drawings, in which.

DESCRIPTION OF THE PREFERRED EMBODIMENT

Figure 1:
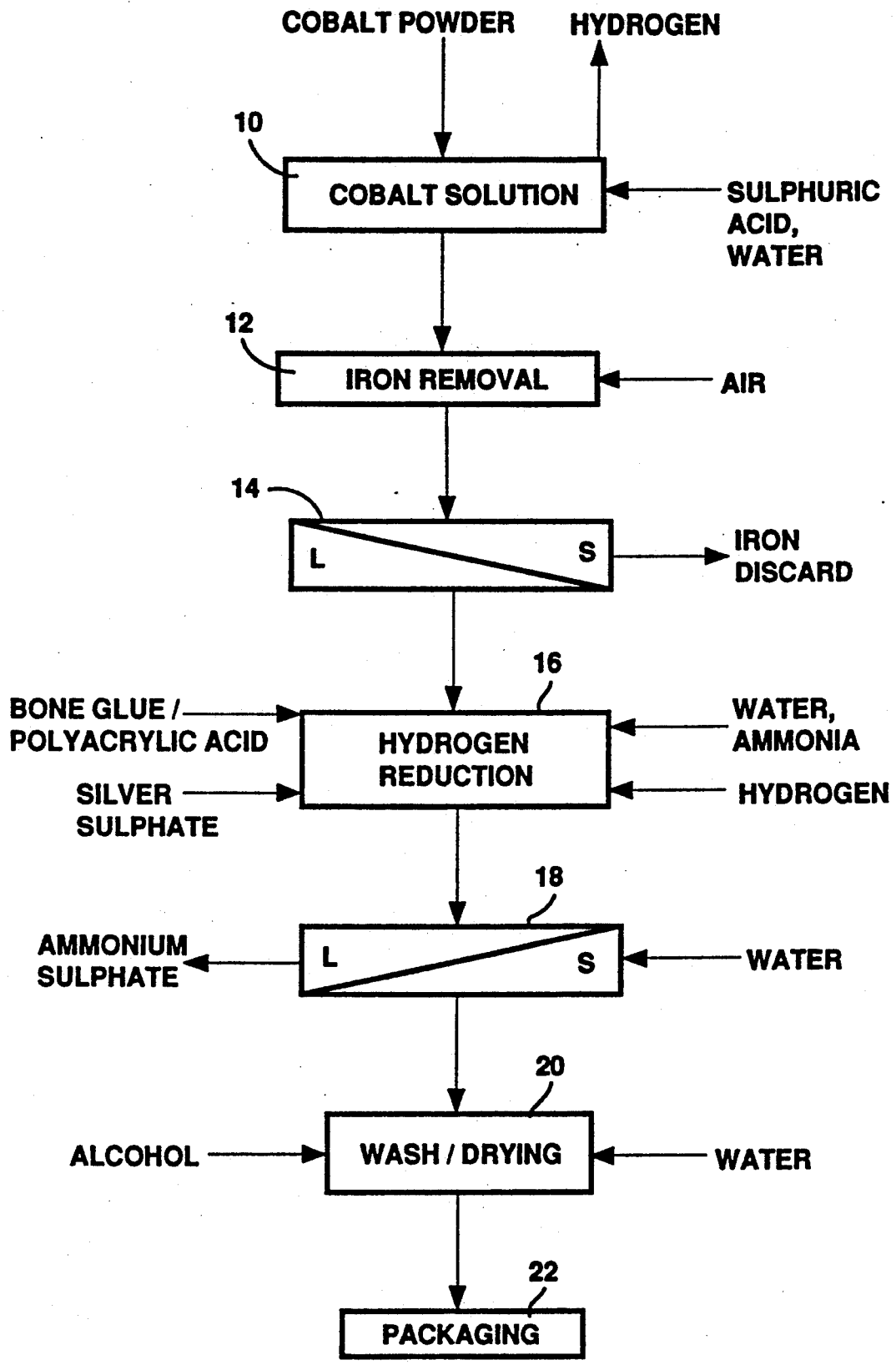
FIG. 1 is a process flowsheet of the reduction process of the invention.
Figure 2:
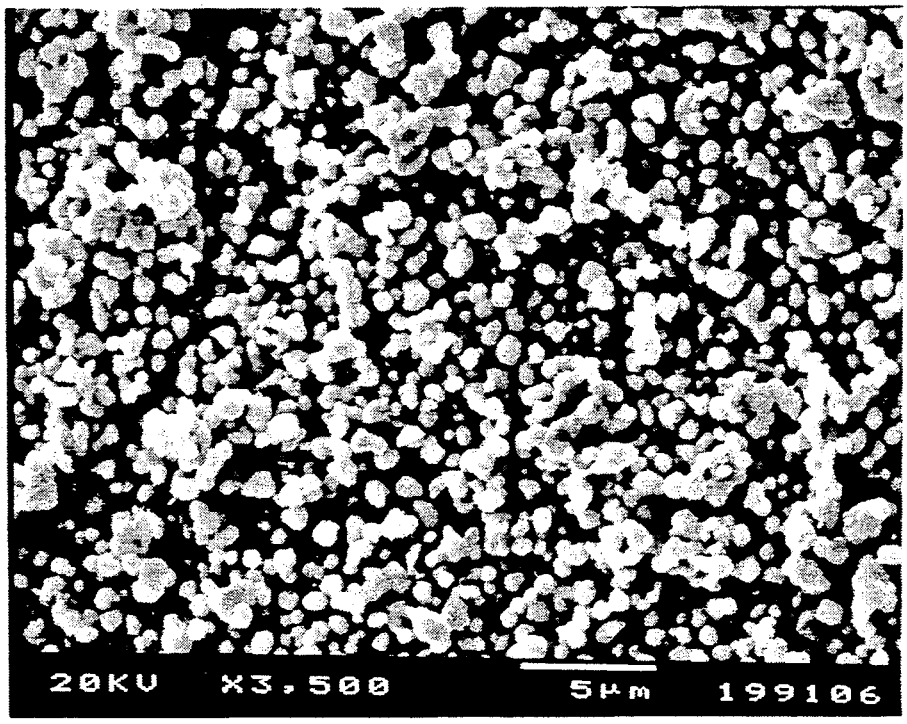
FIG. 2 is a photomicrograph of nodular cobalt metal powder produced according to the invention.

With reference to the flowsheet of FIG. 1, a solution of cobaltous sulphate may be prepared in step 10 by adding cobalt powder to an aqueous sulphuric acid solution, as is well known. Iron present in the solution is removed by addition of air for oxidation of iron at a pH greater than 6.0 and a temperature in the range of 50°-70° C. in step 12 and precipitated iron oxides removed by liquid/solid separation 14 and discarded.

The cobaltous sulphate solution essentially free of iron is fed to an autoclave reactor in step 16 in which concentrated aqua solution is added to provide a pH of about 9.0. Typically, ammonia is added to a cobaltous sulphate solution having a cobalt concentration of about 40 to 80 g/L to provide an ammonia to cobalt mole ratio of 1.5 to 3.0:1, preferably about 2.5:1.

A soluble silver salt, preferably silver sulphate, is added in a ratio of about 1.0 to 10 g of silver per 1 kg of cobalt to be reduced, preferably about 4 g of silver per kg of cobalt to be reduced.

An organic dispersant such as bone glue, gelatin or polyacrylic acid or mixtures thereof, is added for agglomeration control, and the mixture heated to a temperature in the range of 150 to 250° C., preferably about 180° C., with agitation under an applied hydrogen atmosphere to a total pressure of about 2500 to 5000 kPa, preferably about 3500 kPa, for a time sufficient to reduce the cobaltous sulphate to cobalt metal powder.

The agglomeration control additives, preferably a bone glue/polyacrylic acid blend, are added in an amount of up to 2.5% by weight of the cobalt.

The resulting slurry is transferred to liquid/solid separation step 18 for removal of ammonium sulphide and the cobalt metal powder is washed by addition of water. The washed cobalt metal powder is passed to a wash/drying step 20 in which a further water wash is conducted followed by the addition of alcohol for a final wash and drying prior to packaging 22.

The method of the invention will now be described with reference to the following non-limitative examples.

EXAMPLE 1

Cobalt nucleation powder was made in a one gallon laboratory reduction autoclave using procedures which parallel commercial nucleation procedures. All runs used 115 g/L $CoSO_4$ nucleation solution. Solution volumes to provide 80g/L Co were charged to the autoclave along with the polyacrylic acid and the silver salt. The autoclave was then sealed and purged with hydrogen. $NH_4OH$ was introduced into the autoclave after the hydrogen purge was complete. Standard reduction conditions of 190° C. and 3500 kPa total pressure resulted in complete reductions in about 15 minutes.

A standard test using $Na_2S$/NaCN as catalyst produced powder in 15 minutes after a 30 minute induction period. The powder, which analyzed for 0.18% C and 0.18% S, was 100% minus 20 microns and had a Fisher number of 1.65. Test results are shown in Tables 1 and 2.

TABLE 1

| Test | Nucleanon Agent | g Ag/ kg Co | Polyacrylic Acid g/kg Co | $NH_3$:Co Mole Ratio | Induction Time min | Reduction Time min | Product Wt. g |
|---|---|---|---|---|---|---|---|
| 1 | $Ag_2SO_4$ | 7 | 5 | 2.5 | 35 | 12 | 184 |
| 2 | $AgNO_3$ | 7 | 5 | 2.5 | 60 | 20 | 190 |
| 3 | $Na_2S$/NaCN | — | 5 | 2.5 | 40 | 20 | 178 |

TABLE 2

| Test | C % | S % | Microtrac. μm D-90 | D-50 | D-10 | FN |
|---|---|---|---|---|---|---|
| 1 | 0.17 | 0.002 | 12.5 | 6.5 | 3.5 | 1.25 |
| 2 | 0.11 | 0.004 | 38.5 | 13.2 | 5.5 | 3.25 |
| 3 | 0.18 | 0.18 | 17.7 | 8.8 | 4.3 | 1.65 |

Tests using 10 g of $Ag_2SO_4$ per kg of contained Co produced powders in 15 to 20 minutes after induction periods of 20 to 45 minutes. The powders analyzed 0.1 to 0.2% carbon, 0.002 to 0.007% sulphur, were 100% minus 20 microns and had Fisher numbers of 1.25 to 2.40. These results indicate that silver salt is an acceptable alternative to the conventionally used $Na_2S$/NaCN catalyst.

EXAMPLE 2

Cobalt nucleation tests were conducted in a one gallon laboratory autoclave using procedures which parallel commercial procedures described above with reference to FIG. 1. A calculated volume of cobalt plant nucleation solution to provide 80 g/L Co was added to the autoclave along with silver sulphate and a mixture of bone glue and polyacrylic acid. The autoclave was heated to 160° C., and a hydrogen overpressure of 3500 kPa was applied and maintained until the completion of the reduction. A temperature increase of 10 to 20 Celcius degrees was recorded during the reduction. Reduction times of 30 to 60 minutes were observed.

Seven tests were carried out in which an initial nucleation was followed by multiple densifications using cobalt plant reduction feed to determine the growth rate of the powder and the effect of densification on the carbon, sulphur and silver contents of the powder. Densifications were conducted as follows:

hot (170° C.) cobalt plant reduction feed solution was charged into the autoclave containing the nucleation powder; and hydrogen applied until the metal values were reduced.

Upon completion of the reduction, the end solution was flash discharged and the autoclave recharged with fresh feed solution. The additives tested to control particle growth in the densifications were polyacrylic acids such as sold under the trade-marks "ACRYSOL A-1" and "COLLOID 121" and a mixture of bone glue/-polyacrylic acid.

The organic additives were made up as stock solutions containing 10% by weight active ingredient and added by pipette as required.

The levels of $Ag_2SO_4$ catalyst and additives used in the nucleation stages densification stages and the results of the reduction tests are reported in Table 3.

TABLE 3

| Test | g Ag/ kg Co | Organic Additive | Total mL/L | mL/L Nucleation | mL/L Densification |
|---|---|---|---|---|---|
| 4 | 7 | Bone Glue/Polyacrylic Acid | 30 | 15 | 1.5 |
| 5 | 3.5 | Bone Glue/Polyacrylic Acid | 30 | 15 | 1.5 |
| 6 | 0.7 | Bone Glue/Polyacrylic Acid | 30 | 15 | 1.5 |
| 7 | 3.5 | Polyacrylic Acid Acrysol Al | 15 | 15 | — |
| 8 | 4.2 | Polyacrylic Acid Colloid 121 | 22.5 | 15 | 1.5 |
| 9 | 3.5 | Bone Glue/Polyacrylic Acid | 15 | 15 | 0 |
| 10 | 2.0 | Bone Glue/Polyacrylic Acid | 34.5 | 15 | 1.5 |

| Test | Stage | Reduction Time Min | Screen Size (wt. %) +100 | 100/200 | 200/325 | −325 | AD | Analysis, % C | S | Ag |
|---|---|---|---|---|---|---|---|---|---|---|
| 4 | Nuc | 26 | — | — | — | 100 | — | 0.22 | 0.033 | 0.71 |
| | D-5 | 15 | — | — | — | 85 | — | 0.086 | 0.021 | 0.13 |
| | D-10 | 20 | 0 | 7.1 | 70.3 | 22.6 | 2.45 | 0.075 | 0.026 | 0.06 |
| 5 | Nuc | 26 | — | — | — | 100 | — | 0.17 | 0.009 | 0.263 |
| | D-5 | 15 | — | — | — | 98 | — | 0.093 | 0.20 | 0.057 |
| | D-10 | 20 | 0 | 1 | 48.4 | 50.6 | 2.50 | 0.090 | 0.025 | 0.025 |
| 6 | Nuc | 70 | — | — | — | 100 | — | 0.009 | 0.010 | 0.07 |
| | D-5 | 20 | — | — | — | 25 | — | 0.032 | 0.017 | 0.01 |
| | D-10 | 30 | 60.9 | 20.5 | 18.4 | 0.2 | 2.54 | 0.040 | 0.024 | 0.007 |
| 7 | Nuc | 75 | | | Cobalt Plastered | | | | | |

TABLE 3-continued

| | | | | | | | | | | |
|---|---|---|---|---|---|---|---|---|---|---|
| 8 | Nuc | 43 | — | — | — | 100 | — | 0.097 | 0.007 | — |
| | D-5 | 20 | 55.2 | 33.0 | 4.8 | 9.0 | 1.40 | 0.034 | 0.021 | — |
| 9 | Nuc | 30 | — | — | — | 100 | — | 0.084 | 0.005 | — |
| | D-5 | 30 | — | — | — | — | — | 0.041 | 0.021 | — |
| | D-8 | 40 | 98.2 | 1.0 | 0.4 | 0.4 | 2.00 | 0.045 | 0.017 | — |
| 10 | Nuc | 45 | — | — | — | 100 | — | 0.092 | 0.004 | — |
| | D-5 | 20 | — | — | — | 70 | — | 0.082 | 0.023 | — |
| | D-10 | 25 | — | — | — | — | — | 0.056 | 0.022 | — |
| | D-13 | 35 | 37.1 | 39.6 | 20.3 | 3.0 | 2.94 | 0.049 | 0.027 | — |

Three further nucleation tests were conducted to determine the effect of increasing the level of bone glue/polyacrylic acid additive on the degree of powder agglomeration. The results are recorded in Table 4.

TABLE 4

| | Bone Glue/ Polyacrylic Acid | | Reduction | | Analysis | |
|---|---|---|---|---|---|---|
| Test | mL/L | $NH_3$:Co Mole Ratio | Time | Agglomerate Size | C % | S % |
| 11 | 5 | 2.5 | 70 | +100 microns | 0.06 | 0.005 |
| 12 | 10 | 2.5 | 50 | >50 microns | 0.09 | 0.012 |
| 13 | 20 | 2.5 | 40 | 6 microns | 0.012 | 0.019 |

The degree of agglomeration decreased significantly as the additive addition rate was increased from 5 to 20 mL/L with optimum results obtained at an addition rate of 5 to 10 mL/L.

EXAMPLE 3

Two plant trials were conducted in a cobalt plant reduction autoclave using silver sulphate and bone glue/polyacrylic acid to produce nucleation powders. Trial 14, conducted with bone glue/polyacrylic acid added at the rate of 3.0 mL/L, produced powder with a Fisher number of 2.75 and an average agglomerate size of 22 microns. This powder received about 30 densifications of cobalt plant reduction feed and produced commercial S grade cobalt powder. The second trial (Trial 15) conducted with the bone glue/polyacrylic acid, added at the rate of 1.6 mL/L, produced agglomerates in excess of 150 microns in size which were leached to remove them from the autoclave.

Changes and results of the plant trials are reported in Table 5.

TABLE 5

| | Bone Glue/ Polyacrylic Acid | | Reduction | | Analysis | |
|---|---|---|---|---|---|---|
| Test | mL/L | $NH_3$:Co Mole Ratio | Time | Agglomerate Size | C % | S % |
| 14 | 3.0 | 2.4 | 60 | 22 microns | 0.06 | 0.05 |
| 15 | 1.6 | 2.8 | 90 | >150 microns | 0.02 | 0.05 |

A standard plant nucleation using $NaCN/Na_2S$ catalyst with bone glue/polyacrylic acid added at 1.5 mL/L, nucleation powder approximately 15 microns in particle size. Laboratory nucleations conducted in a one gallon autoclave using NaCN/NaS cataylst required 15 mL/L bone glue/polyacrylic acid to yield similar sized nucleation powder.

It will be understood that changes and modifications may be made in the embodiments of the invention without departing from the scope and purview of the appended claims.

What I claim as new and desire to protect by Letters Patent of the United States is:

1. A process for the production of cobalt powder from an ammoniacal cobaltous sulphate solution comprising adding silver sulphate to said solution in an amount to provide a soluble silver to cobalt ratio in the range of about 1 g to 10 g silver per kg of cobalt to be reduced, adding an organic dispersant in an amount effective to prevent agglomeration of cobalt metal powder to be produced, and heating said solution to a temperature in the range of 150 to 250° C. with agitation under a hydrogen pressure of 2500 to 5000 kPa for a time sufficient to reduce the cobaltous sulphate to cobalt metal powder.

2. A process as claimed in claim 1 in which said organic dispersant is selected from the group consisting of bone glue, polyacrylic acid, and a mixture of bone glue and polyacrylic acid.

3. A process as claimed in claim 1 in which said organic dispersant is a mixture of bone glue and polyacrylic acid.

4. A process as claimed in claim 3 in which ammonia is added to the solution prior to the addition of silver sulphate in an amount of provide an ammonia to cobalt mole ratio of about 1.5:1 to 3.0:1.

5. A process as claimed in claim 3 in which ammonia is added to the solution prior to the addition of silver sulphate in an amount to provide an ammonia to cobalt mole ratio of about 2.5:1.

6. A process as claimed in claim 5 in which the mixture of bone glue and polyacrylic acid is added at a rate of about 0.01 L of said mixture per liter of solution.

7. A process as claimed in claim 5 in which the mixture of bone glue and polyacrylic acid is added in an effective amount up to about 2.5% by weight of the cobalt.

8. A process as claimed in claim 7 in which the silver sulphate is added in an effective amount to provide about 4g silver sulphate per 1 kg of cobalt to be reduced.

9. A process for the production of cobalt powder which comprises adding ammonia to a solution of cobaltous sulphate containing a cobalt concentration of 40 to 80 g/L to yield an ammonia to cobalt mole ratio of about 1.5:1 to 3.0:1, adding silver sulphate to yield a silver sulphate to cobalt weight ratio of about 1.0 g to 10 g silver:1 kg cobalt, adding a mixture of bone glue and polyacrylic acid in an amount of about 0.01 to 2.5% of the weight of the cobalt,. heating said mixture to a temperature in the range of 150° to 250° C., and agitating said mixture in a hydrogen atmosphere until cobaltous cobalt is reduced to cobalt metal powder.

10. A process as claimed in claim 8 in which the solution contains about 60 to 80 g/L cobalt and has an ammonia to cobalt mole ratio of about 2.5:1.

11. A process as claimed in claim 9 in which an effective amount of silver sulphate is added to yield a silver to cobalt weight ratio of about 4 g silver:1 kg cobalt.

12. A process as claimed in claim 10 in whch the mixture is heated to about 180° C.

* * * * *